US005748431A

United States Patent [19]

Goodnight et al.

[11] Patent Number: 5,748,431

[45] Date of Patent: May 5, 1998

[54] SOLENOID DRIVER CIRCUIT

[75] Inventors: Trent Lynn Goodnight, Waterloo; Vijay Manilal Dharia, Cedar Falls, both of Iowa

[73] Assignee: Deere & Company, Moline, Ill.

[21] Appl. No.: 731,472

[22] Filed: Oct. 16, 1996

[51] Int. Cl.[6] ..... H01H 9/00

[52] U.S. Cl. ..... 361/154; 361/187; 361/203

[58] Field of Search ..... 361/152, 153, 361/154, 160, 170, 187, 203

[56] References Cited

U.S. PATENT DOCUMENTS

| | | | |
|---|---|---|---|
| 4,295,177 | 10/1981 | Woodhouse et al. | 361/154 |
| 4,764,840 | 8/1988 | Petrie et al. | 361/154 |
| 4,817,499 | 4/1989 | Bellanger et al. | 91/361 |
| 4,825,333 | 4/1989 | Clive et al. | 361/154 |
| 4,930,040 | 5/1990 | Binarsch et al. | 361/154 |
| 4,964,014 | 10/1990 | Boe et al. | 361/187 |
| 5,075,568 | 12/1991 | Bilotti et al. | 307/270 |

FOREIGN PATENT DOCUMENTS

| | | |
|---|---|---|
| 2 548 840 | 1/1985 | France . |
| 29 16 322 | 11/1980 | Germany . |
| 3338764 | 5/1985 | Germany . |
| 2 037 102 | 7/1980 | United Kingdom . |

*Primary Examiner*—Jeffrey A. Gaffin
*Assistant Examiner*—Michael J. Sherry

[57] ABSTRACT

An electrical circuit applies an oscillatory electrical current to a coil of a solenoid in order to cause the solenoid to move in response to a command signal. The circuit includes a signal divider for generating an upper peak current signal value from the command signal and a lower peak current signal value which is a fixed percentage of the upper peak current signal value. A current sense resistor generates a current sense voltage representing current through the coil. A first comparator compares the current sense voltage to the upper current signal value. A second comparator compares the current sense voltage to the lower current signal value. A set/reset flip-flop latches a current driver on and off. A current driver applies a driving current to the solenoid coil as a function of output signals generated by the first and second comparators so that the coil current will have a lower peak current value which is substantially a fixed percentage of the upper peak current value.

7 Claims, 1 Drawing Sheet

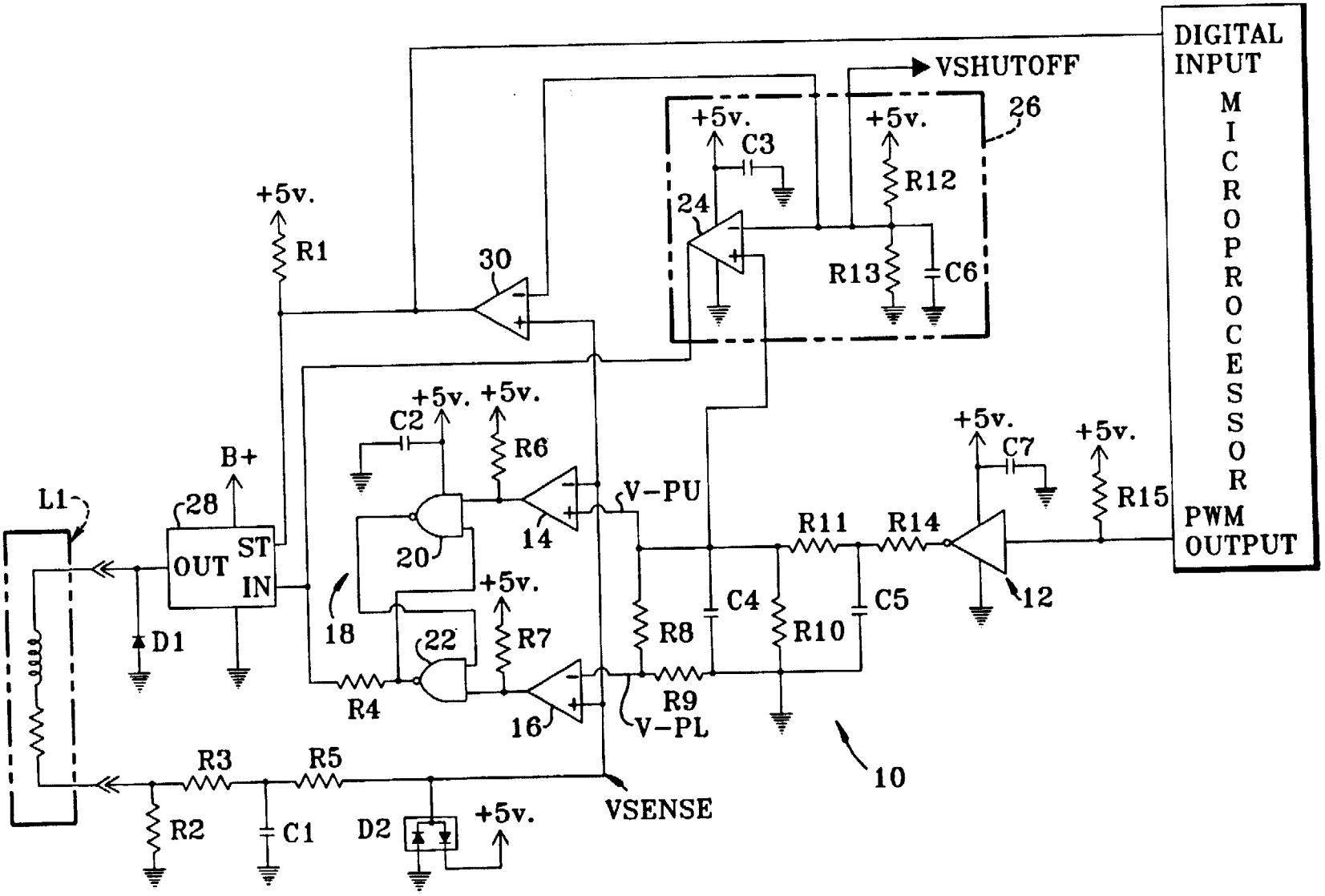
DIGITAL INPUT
MICROPROCESSOR
PWM OUTPUT
VSHUTOFF
26
+5v.
R12
C6
R13
C3
24
R15
C7
12
R14
C5
R11
R10
C4
10
V-PU
R8
R9
V-PL
VSENSE
30
R6
14
R7
16
C2
20
22
R4
18
D2
R1
B+
ST
IN
OUT
28
D1
R5
C1
R3
R2
L1

SOLENOID DRIVER CIRCUIT

BACKGROUND OF THE INVENTION

This invention relates to an electrical circuit for providing controlled electrical current to a solenoid, such as the solenoid of a hydraulic control valve.

It is desired to use analog current controlled solenoid valves to control the hydraulic pressure applied to clutches in a power-shift transmission. Precise current control is required for smooth and predictable modulation of the transmission elements when shifting from one gear to another. Because of power dissipation, it is not practical on a vehicle to control current to an analog valve by controlling the voltage supply to it. So, to generate the desired current command, the supply voltage is pulsed on and off at a fast rate. The inductance in the coil stores energy when the voltage is pulsed on, and releases energy when the voltage is off, thus producing an average current.

However, current control is difficult in such an application because the primary electrical characteristics of the control valves, resistance and inductance, are unknown and unpredictable. Resistance of the coil can change by over 100% throughout the temperature range to which it is subjected. Similarly, the inductance of the coil can change by well over 100% due to variations of temperature, voltage pulse frequency, and supply current. Furthermore, the amplitude of the voltage pulses can range from 9 to 16 volts.

It is known to filter the pulsing current, measure its average, and compensate the command until the desired average current is achieved. But, such a technique does not work well in a transmission control application. This because during a shift the command to a valve is changing rapidly. The command is either ramping up or down depending on whether the transmission element is coming on or going off. To measure real-time average current the command must be held constant for some time. But, during a shift there is not sufficient time available for this to be done. Therefore, it would be desirable to have a valve driver which produces an accurate average current in a coil that has an unknown resistance and an unknown inductance without feedback sensing of the average current.

SUMMARY OF THE INVENTION

An object of the present invention is to provide a solenoid valve driver which produces an average current which is linearly related to commanded peak current.

Another object of the present invention is to provide a valve driver wherein the coil current will have a lower peak current value which is substantially a fixed percentage of the upper peak current value.

Another object of the present invention is to provide precise current control of a solenoid driver with immediate response (minimum delay between commanded current and actual current).

Another object of the present invention is to provide a system for controlling solenoid current which can be made with few components and at low cost, and which places few demands (software overhead) on a microprocessor.

Another object of the present invention is to optimize the frequency of the solenoid driver at the nominal operating point (nominal current, resistance, inductance and supply voltage) by selecting the proper resistor divider network.

Another object of the present invention is to provide the maximum fault detection of the solenoid driver circuit.

Another object of the present invention is to provide a circuit wherein the output current to the solenoid is zero on power-up and/or during the reset mode of the microprocessor.

These and other objects are achieved by the present invention wherein an electrical circuit applies an oscillatory electrical current to a coil of a solenoid in order to cause the solenoid to move in response to a command signal. The circuit includes a signal divider for generating an upper peak current signal value from the command signal and a lower peak current signal value which is a fixed percentage of the upper peak current signal value. A current sense resistor generates a current sense voltage representing current through the coil. A first comparator compares the current sense voltage to the upper current signal value. A second comparator compares the current sense voltage to the lower current signal value. A current driver applies a driving current to the solenoid coil as a function of output signals generated by the first and second comparators so that the coil current will have a lower peak current value which is substantially a fixed percentage of the upper peak current value. The average current linearly follows the peak current, because the lower peak is always a fixed percentage of the commanded upper peak current. As the ratio between peaks is constant, the linearity between average current and commanded peak current holds even if the inductance and/or resistance of the coil changes or if the supply voltage changes. As peak-to-peak amplitude increases with the average current, the frequency range of the solenoid driver is minimized.

BRIEF DESCRIPTION OF THE DRAWINGS

The sole Figure is a detailed circuit diagram of the solenoid driver circuit of the present invention.

DETAILED DESCRIPTION

The solenoid driving circuit 10 controls the current applied to the coil L1 of a solenoid operated transmission control valve (not shown) in response to an analog voltage command signal V-CMD generated by the PWM output of a microprocessor MP. Preferably, the command signal will have a voltage range of 0 to 5 volts corresponding to a desired coil current of 0 to 1000 miliamps. Pull-up resistor R15 (connected to a 5 volt regulator supply voltage) and inverter 12 convert the commanded PWM signal of 0% to 100% duty cycle to 5 to 0 volts analog voltage using a 2 milisecond filter circuit comprised of resistor R14 and capacitor C5.

The filtered command signal is then applied to a voltage divider formed by resistors R11 and R10 which supplies a commanded voltage V-PU (voltage peak-upper) at the common connection therebetween. A slight amount of additional filtering is supplied by capacitor C4 which is connected in parallel with R10. The voltage V-PU is applied to the input of a reset command comparator 14 and to a voltage divider formed by resistors R8 and R9 connected between V-PU and ground. The common connection between R8 and R9 provides a V-PL (voltage peak-lower) signal which is a certain fixed percentage of V-PU, and which is applied to the – input of a set command comparator 16.

The output of reset command comparator 14 is connected to +5 volts via resistor R6 and is applied to an input of a set/reset flip flop 18 (with Schmidt Trigger input) formed by a pair of cross-connected NAND gates 20, 22 and capacitor C2. The output of set command comparator 16 is connected to +5 volts via resistor R7 and is applied to the an input of a set/reset flipflop 18.

V-PU is also applied to the + input of comparator 24 which, with grounded capacitor C3, is part of a shutoff circuit 26. A voltage divider formed by resistor R12 and R13 between +5 volts and ground generates a shutoff voltage V-SHUTOFF which is applied to the – input of comparator 24 so that comparator 24 will generate a shutoff signal until V-PU reaches a level representing a coil current of approximately 150 miliamps. A capacitor C6 is connected between ground and the common connection between R12 and R13. The output of comparator 24 (and of shutoff circuit 26) is connected to the IN input of driver 28. The output of driver 28 is connected to one end of the solenoid coil L1 and to ground via fly-back diode D1.

The other end of coil L1 is connected to ground via current sense resistor R2. The voltage across resistor R2 is proportional to the current through coil L1, and is filtered from high frequency noise by resistor R3, capacitor C1 and resistor R5 to generate a voltage VSENSE. Voltage transient suppression is performed by diode D2. Voltage VSENSE is applied to the + input of comparator 16 and to the – input of comparator 14.

A comparator 30 has a + input to which is applied VSENSE and a – input to which is applied voltage VSHUTOFF. The output of comparator 30 is connected to +5 volts via pull-up resistor R1 and to the status input ST of driver 28 and pulls the ST input low when VSENSE is below VSHUTOFF. The output of comparator 30 generates a status signal which is applied to a digital input of the microprocessor MP so that the microprocessor can detect circuit faults when the commanded voltage V-PU is greater than a value corresponding to a coil current of 150 miliamps. The status signal must be ignored until the command is greater than 150 miliamps.

Preferably, the driver 28 may be a Siemens' Profet device or equivalent, which has built-in features to detect open or short circuits in the coil L1. When the driver 28 detects a fault, it pulls its status line ST low.

Comparator 16 pulls its output to ground when VSENSE is too low (less than V-PL). Comparator 14 pulls its output to ground when VSENSE is too high (greater than V-PU). In this example, resistors R8 and R9 are chosen so that V-PL is 78.5% of V-PU. When VSENSE is below V-PL, the driver 28 is turned on (set) and remains on until V-SENSE climbs above V-PU. When VSENSE reaches V-PU, the driver 28 is turned off (reset) until once again VSENSE falls below V-PL.

To make sure the driver 28 is off when the commanded voltage is too low, the V-PU and a small fixed voltage VSHUTOFF are fed into the comparator 24. When the commanded voltage from the microprocessor MP is less than a value corresponding to a coil current of 150 miliamps the comparator 24 pulls the input to driver 28 low, turns the driver 28 off, and prevents flip-flop 18 from turning the driver 28 on.

With this circuit, the average current through coil L1 linearly follows the peak current because the lower peak current is always a fixed percentage of the upper peak current. As the command increases the peak-to-peak amplitude increases, but the ratio between the upper peak and the lower peak is constant. The linearity holds even if the inductance and/or resistance of the coil changes and/or if the supply voltage changes. Thus, as the command signal varies, the coil current upper peak and lower peak values vary while the variable coil current lower peak value remains a fixed percentage of the variable coil current upper peak value.

This circuit will run at a variable frequency. The frequency varies as a function of command voltage, resistance and inductance of a coil, and supply voltage. But since peak-to-peak amplitude increases as the average current increases, the frequency variation is much less than if the peak-to-peak amplitude was constant. The R8, R9 resistor divider ratio can be chosen to optimize the frequency at the nominal operating point (nominal current, resistance and inductance of a coil, and supply voltage).

One of these control circuits can be used with multiple drivers if the drivers are never on at the same time. For example, one forward and one reverse driver could share a common low-side return and current sense circuit. The input to the forward driver could simply be ANDed with the forward switch, and the reverse driver ANDed with the reverse switch. The microprocessor would drive the same command circuit regardless of which valve was actually being supplied.

Finally, this circuit is simple and consists of inexpensive components. Microprocessor overhead is extremely light as it only has to generate the PWM command signal. A/D inputs are not tied up since average current is not measured by the microprocessor. No equations or tables are required to convert duty cycle to current since the relationship is linear. However, the PWM signal should have a fairly high frequency so the time constant of R14, C5 filter can be minimized, or D/A converters could be used as well. Note that the sense resistor R2 should be chosen as large as possible and should preferably have a ±1% tolerance. Likewise, resistors R8, R9, R10, R11 and R14 should preferably have a ±1% tolerance. The ground path between the sense resistor R2 and the comparators 14, 16, 24 and 30 should have a very low impedance. The accuracy of the 5 volt regulator supply voltage supplied to the inverter 12 is also important.

The following is a table of components which may be used in the electronic circuits illustrated in the Figure. These components are merely exemplary and other components could be utilized without departing from scope of the present invention.

| Exemplary Components | |
|---|---|
| Resistors | |
| R1, R6, R7, R15 | 10 kOhms |
| R2 | 1.0 Ohms |
| R3, R5 | 4.7 k |
| R4 | 2.7 k |
| R8 | 13 k |
| R9 | 47.5 k |
| R10 | 10.2 k |
| R11 | 23.7 k |
| R12 | 27.4 k |
| R13 | 1.0 k |
| R14 | 6.04 k |
| Capacitors | |
| C1 | 47 pf |
| C2, C3, C4, C6, C7 | .047 Mf |
| C5 | .33 Mf |
| Diodes | |
| D1 | GI S2G |
| D2 | BAV99 |
| Integrated Circuits | |
| 12 | 74HC14 (Hex schmidt trigger Inverter) |
| 14, 16, 24, 30 | LM2901 (Quad comparator) |
| 20, 22 | 74HC132 (Quad schmidt trigger Nand gates) |
| 28 | BTS410F |
| Microprocessor | 8 Bit (80C517A) |

While the invention has been described in conjunction with a specific embodiment, it is to be understood that many alternatives, modifications and variations will be apparent to those skilled in the art in light of the foregoing description. For example, without departing from the principle of the invention, the non-inverting power switching device could be replaced with an inverting device with an inverting intermediate driver stage. Accordingly, this invention is intended to embrace all such alternatives, modifications and variations which fall within the spirit and scope of the appended claims.

We claim:

1. An electrical circuit for applying an oscillatory electrical current to a coil of a solenoid in order to cause the solenoid to move in response to an input signal, characterized by:

the circuit supplying the coil with a current which has variable upper and lower peak current values and wherein the lower peak current value is substantially a fixed percentage of the upper peak current value.

2. The invention of claim 1, wherein the circuit comprises:

a signal divider for generating an upper signal value from the input signal and a lower signal value which is a fixed percentage of the upper signal value;

a current sensor for generating a current sense signal representing current through the coil;

a first comparator for comparing the current sense signal to the upper signal value;

a second comparator for comparing the current sense signal to the lower signal value; and a power switching device coupled to a potential source and to the solenoid coil, the power switching device controllably connecting and disconnecting the potential source to the solenoid coil as a function of output signals from the first and second comparators.

3. The circuit of claim 2, further comprising:

a set/reset flipflop circuit connected between the comparators and the power switching device.

4. The circuit of claim 2, further comprising:

a shutoff circuit having a first input to which is applied the upper signal value, a second input to which is applied a shutoff signal and an output connected to an input of the power switching device, the shutoff circuit operating to turn off the power switching device until the upper signal value reaches a level of the shutoff signal.

5. The circuit of claim 1, further comprising:

a fault detection circuit for generating a fault signal when the input signal is greater than a certain value.

6. An electrical circuit for applying an oscillatory electrical current to a coil of a solenoid in order to cause the solenoid to move in response to a variable magnitude command signal, characterized by:

a signal divider for generating a variable upper peak current signal value from the command signal and a variable lower peak current signal value which is a fixed percentage of the upper peak current signal value;

a current sensor for generating a current sense signal representing current through the coil;

a first comparator for comparing the current sense signal to the upper current signal value;

a second comparator for comparing the current sense signal to the lower current signal value;

a set/reset flipflop circuit connected to the comparators; and a current driver for applying a driving current to the solenoid coil as a function of output signals of the set/reset flipflop circuit, the current driver supplying the coil with a current which has variable upper and lower peak current values and wherein the lower peak current value is substantially a fixed percentage of the upper peak current value.

7. The circuit of claim 6, further comprising:

a shutoff circuit having a first input to which is applied the upper current signal value, a second input to which is applied a shutoff signal and an output connected to an input of the current driver, the shutoff circuit operating to turn off the current driver until the upper current signal value reaches a level of the shutoff signal.

* * * * *